United States Patent [19]

Clifton, Jr.

[11] Patent Number: 4,949,492

[45] Date of Patent: Aug. 21, 1990

[54] QUICK RELEASE MAGAZINE CATCH

[75] Inventor: Norman E. Clifton, Jr., Jacksonville, Fla.

[73] Assignee: Prezine, Inc., Jacksonville, Fla.

[21] Appl. No.: 414,284

[22] Filed: Sep. 29, 1989

[51] Int. Cl.[5] ..... F41C 23/12
[52] U.S. Cl. ..... 42/7
[58] Field of Search ..... 42/7; 89/196

[56] References Cited

U.S. PATENT DOCUMENTS 4,713,902 12/1987 Wigton ..... 42/7
4,759,144 7/1988 Egan et al. ..... 42/7

FOREIGN PATENT DOCUMENTS 375994 5/1923 Fed. Rep. of Germany ..... 42/7
3035796 5/1982 Fed. Rep. of Germany ..... 42/7
344930 3/1931 United Kingdom ..... 42/7

*Primary Examiner*—Stephen C. Bentley
*Attorney, Agent, or Firm*—Arthur G. Yeager

[57] ABSTRACT

A mechanism including a thumb operated pivotable lever mounted on the side of an automatic piston grip to release the magazine; the lever including an inclined plane which engages a roller on the end of a magazine catch rod and causes the rod to slide inwardly of the handle grip portion to release the magazine; the magazine catch rod being spring biased to urge the roller outwardly toward the inclined plane of the lever.

10 Claims, 5 Drawing Sheets

QUICK RELEASE MAGAZINE CATCH

BACKGROUND OF THE INVENTION

Automatic pistols, such as the Colt pistol, have a magazine of bullets which slides upward in a passageway in the handle of the pistol until it is fully inserted and a catch snaps into place to hold the magazine in the fully inserted position, from which bullets are fed into the firing chamber. The mechanism of the prior art pistol is operated by pushing inwardly on a spring biased button on the side of the handle just to the rear of the trigger. While this button can be pushed by the thumb of the hand holding the gun, it is somewhat awkward to do so without releasing the grip of the hand on the gun. And, of course, the button could be pushed by a finger from the other hand of the user. For those users who desire a minimum of time and effort in releasing an empty magazine and loading a full magazine, the prior art mechanism is too cumbersome. The present invention provides a quick release mechanism which does not require any loosening of the hand holding and firing the gun.

It is an object of the present invention to provide a novel magazine catch and release magazine. It is another object of this invention to provide a quick release mechanism which can be operated with the thumb of the hand holding the gun without releasing the grip of the hand about the gun handle. Still other objects will become apparent from the more detailed description which follows.

BRIEF SUMMARY OF THE INVENTION

This invention relates to an improved quick release magazine catch mechanism for an automatic pistol having a hollow hand grip portion to receive a magazine, the improved quick release magazine catch mechanism including a pivotable thumb operated lever, a lever support plate, pivot pin means connecting said lever to said plate, a spring biased magazine catch slidably engaged with said hand grip portion and having a roller means engageable with an inclined plane on said lever to cause said catch to slide laterally to release the magazine when said lever is pivoted downwardly.

In specific embodiments of the invention the lever is fastened through a bushing to the lever support plate with only the thumb pad portion of the lever extending outwardly of the grip of the gun; and a protective extension of the lever support plate positioned between the thumb of the user and the barrel slide of the gun.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

This invention has a specific relationship to a Model 1911 Colt automatic pistol in that it is designed to replace the magazine catch, the magazine catch spring, and the magazine catch spring guide so as to transform the pistol into one having a thumb operated quick release for the magazine. Such a quick release is highly desirable in target shooting contests with such a pistol. It is, of course, also suitable for law enforcement officials and military personnel. The spirit of this invention is not limited to the Model 1911 Colt automatic pistol, but is readily applicable to other pistols having magazines in the interior of the handle or butt of the gun.

Figure 1:
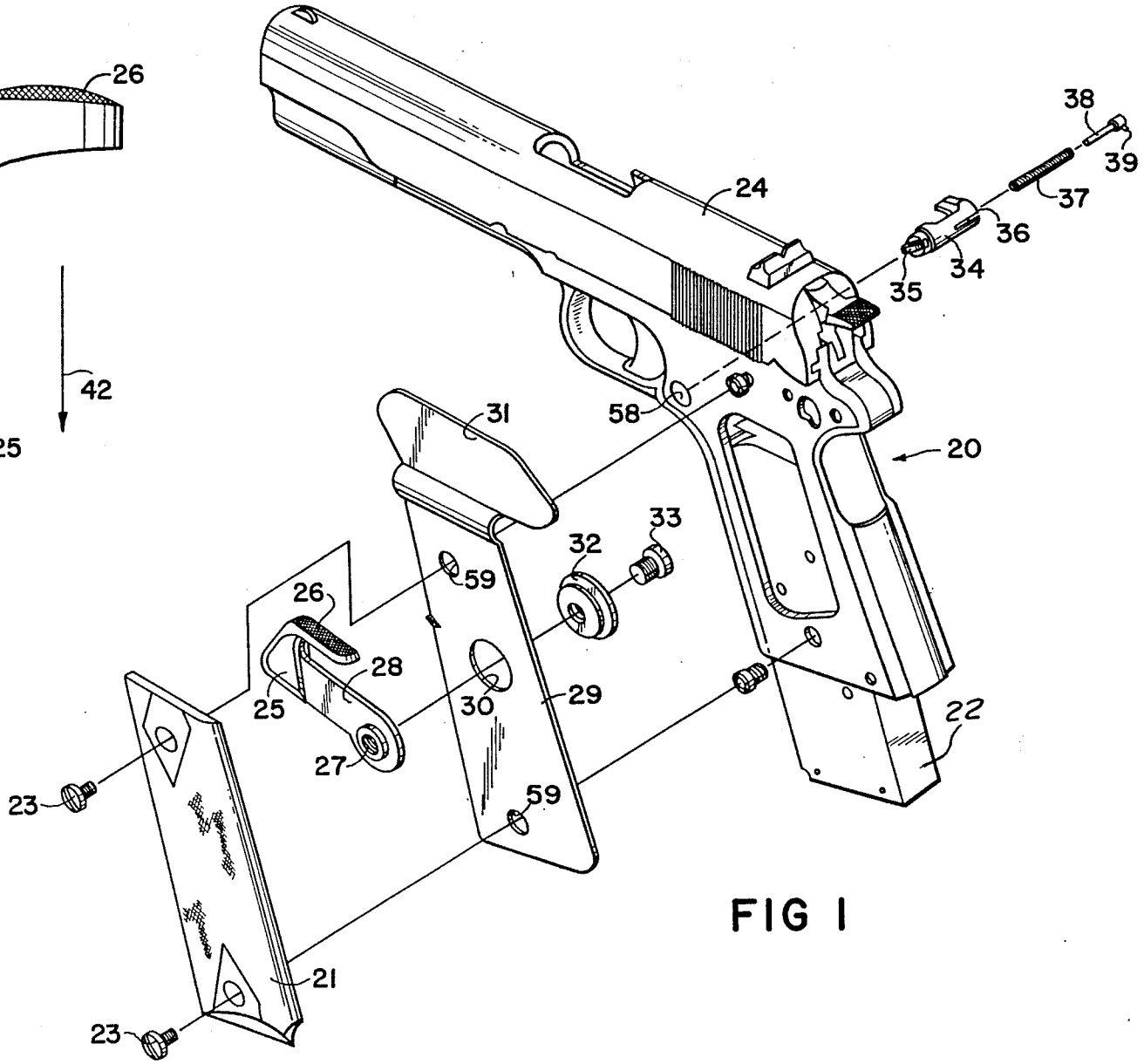
FIG. 1 is an exploded perspective view of the mechanism of this invention and where it is positioned on a Colt 1911 style automatic pistol.

In FIG. 1 there is shown an exploded view of a Model 1911 Colt automatic pistol modified to use the present invention. The pistol has a barrel and a barrel slide 24 mounted on a frame which includes a hollow handle portion 20 containing a recess for a magazine 22 of cartridges to slide in for loading the pistol. In the unmodified pistol there is a lateral passageway 58 immediately to the rear of the trigger into which the magazine catch device slides from a right side entrance, and is locked in place leaving a small knurled button protruding from the left side of passageway 58. To release the magazine 22 the knurled button is pushed inwardly usually with the thumb of the right hand (for right-handed shooters), but in so doing the hand is loosened and shifted from its firing grip. Accordingly, in the changing of magazines in the prior art pistol some time is lost in loosening the hand grip, changing the magazine and regripping the handle to continue firing. The present invention permits the changing of the magazine without loosening the hand grip around the handle or butt of the gun.

Figure 2:
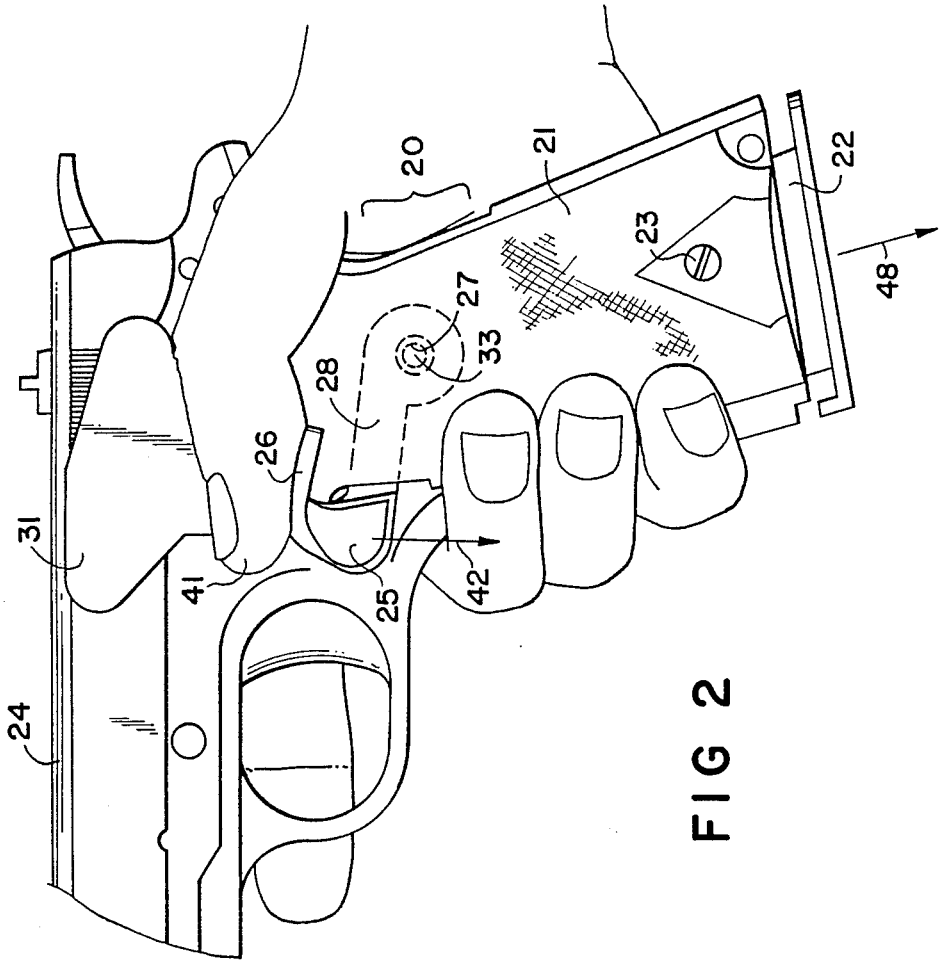
FIG. 2 is an enlarged side elevation of a pistol including this invention as held in the hand of a user.

In FIG. 1 there is shown the handle portion 20 of the frame of the pistol with grip 21 removed by loosening screws 23. The backside of grip 21 is routed out to accommodate for lever 25, lever support plate 29, bushing 32, and screw 33. Thus, when grip 21 is reassembled to handle portion 20 with the new parts added, the outside thickness of the handle will remain the same and the feel of the butt in the user's hand will be the same. Lever 25 is assembled to lever support plate 29 by fitting bushing 32 into hole 30 and fastening lever 25 thereto by tightening screw 33 into threaded hole 27 in lever 25. The assembly permits lever 25 to pivot around the center of bushing 32 which is rotatable in hole 30. Grip 21 can then be fastened to handle portion 20 again by tightening screws 23. The assembled gun will appear as shown in FIG. 2 with thumb pad 26 extending outwardly from grip 21 while the remainder of lever 25, bushing 32, and lever support plate 29 is covered by grip 21, with one exception. The upper extension 31 of lever support plate 29 extends upwards from the top of grip 21 to near the top of barrel slide 24 of the gun. In this position the shooter's thumb 41 can rest against extension 31 and against thumb pad 26 without fear of touching slide 24 which moves rearwardly and forwardly in a reciprocating motion each time the gun is fired. It is to be noted that thumb 41 is in the identical, or almost the identical, position in FIG. 2 as it would be when firing the unmodified gun. When the shooter wishes to release the magazine 22 to replace an empty magazine with a full magazine thumb 41 is pressed downwardly in the direction of arrow 42 causing lever 25 to pivot around screw 33 releasing magazine 22 by moving the catch mechanism (not shown) laterally (perpendicular to the plane of the page of drawing). Magazine 22 will then fall out in the direction of arrow 48 leaving room to insert a new magazine.

The magazine catch mechanism includes (as shown in FIG. 1) magazine catch body 34, a generally cylindrical member which slides laterally into passageway 58 from an entrance on the right side of the gun, a spring 37, and a spring guide and lock pin 38 having a lock arm 39 extending outwardly from the head of guide and lock pin 38. Spring 37 is seated in an internal recess in body 34 and locked in place by turning guide and lock pin through an arc to seat lock arm 39 in a groove seat in body 34. This portion of the mechanism is discussed in more detail below with respect to FIGS. 8–12.

Figure 3:
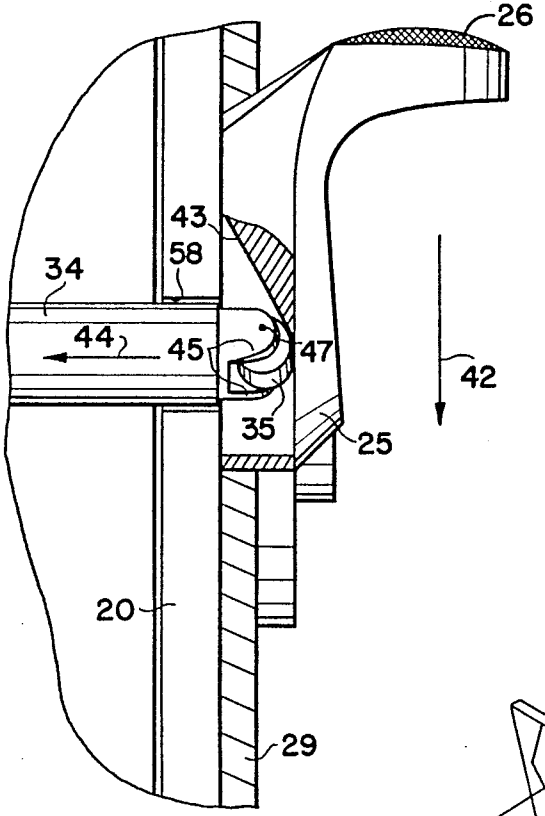
FIG. 3 is an enlarged front elevation (partly in cross section) of the mechanism of this invention showing the cam action of the thumb operated lever.

In FIG. 3 there is shown the cam action by means of which lever 25 moves magazine catch body laterally to release magazine 22. As seen in FIG. 1 lever 25 includes a threaded hole 27, a flat connecting bar 28 and a thumb pad 26. In FIG. 3 there is a view looking from the barrel of the gun toward the handle or butt and showing the frame 29 of the handle portion of the gun and the lateral passageway 58 through which extends magazine catch body 34. The end of body 34 extending outwardly from frame 29 has a roller 35 positioned between two forked supports 45 through which passes shaft 47 around which roller 35 freely rotates. On the side of lever 25 facing roller 35 is an inclined plane 43 which engages roller 35. When thumb pad 26 is pressed downwardly in the direction of arrow 42, plane 43 presses against roller 35 pushing it inwardly in the direction of arrow 44. This movement of magazine catch body 34 causes a catch means (not shown) to release magazine 22. When the new magazine is inserted thumb pad 26 is released removing the pressure on roller 35 which then moves outwardly (opposite to arrow 44) due to the release of spring 37. The outward movement of body 34 causes the catch means to engage the new magazine and pushes lever 25 and thumb pad 26 upwardly (opposite to arrow 42 to return them to the position for the next release of magazine 22.

Figure 5:
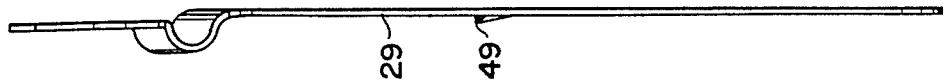
FIG. 5 is an end elevation of the lever support plate of FIG. 4.
Figure 4:
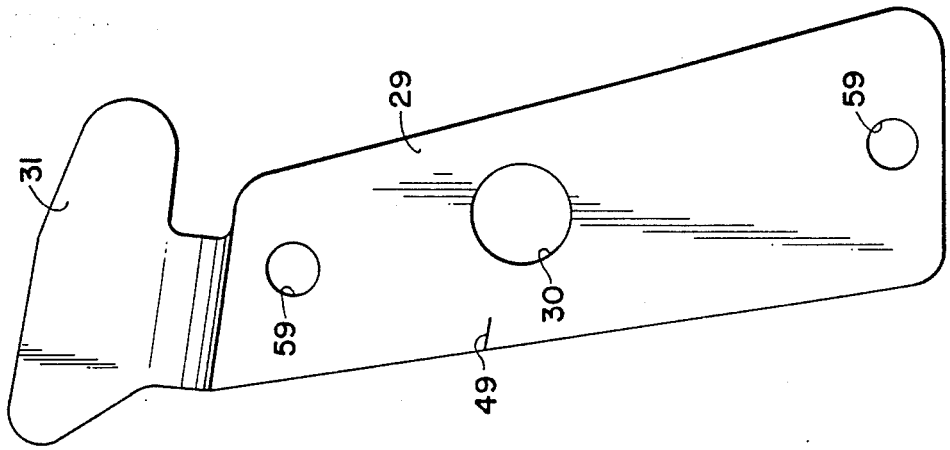
FIG. 4 is a side elevation of the lever support plate of this invention.

FIGS. 4 and 5 show two views of lever support plate 29 having an upper extension portion 31, a central hole 30 to receive bushing 32, two holes 59 for fastening screws 23 (see FIG. 1). There also is shown a stop ledge 49 to engage connecting bar 28 of lever 25 to prevent any pivoting of lever 25 beyond that point. Stop 49 may be any item which will engage connecting bar 28; that shown here is merely an offset cut in plate 29.

Figure 7:
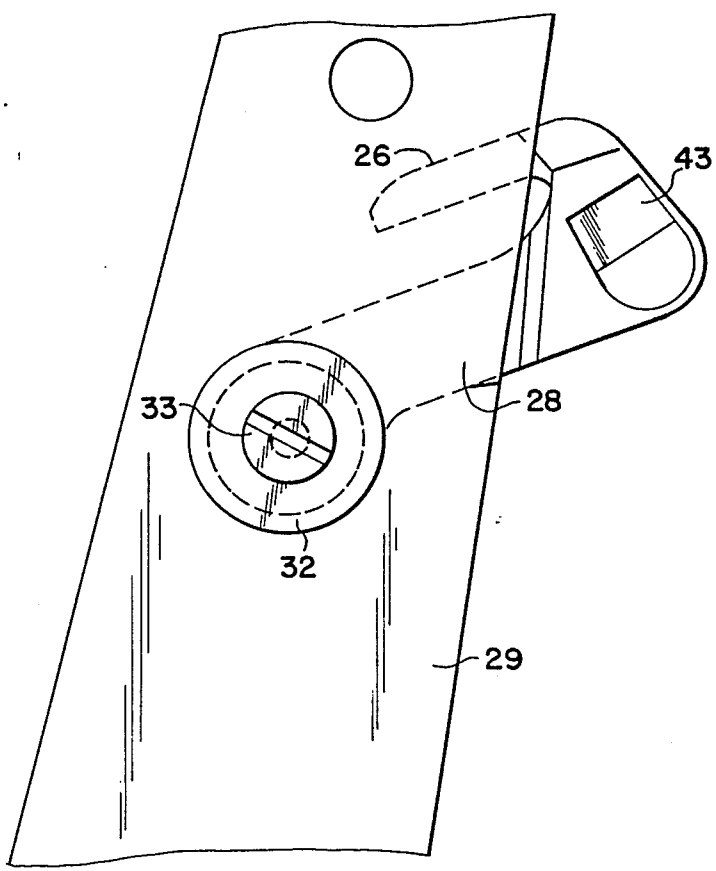
FIG. 7 is a right side elevation of the lever and plate shown in FIG. 6.
Figure 6:
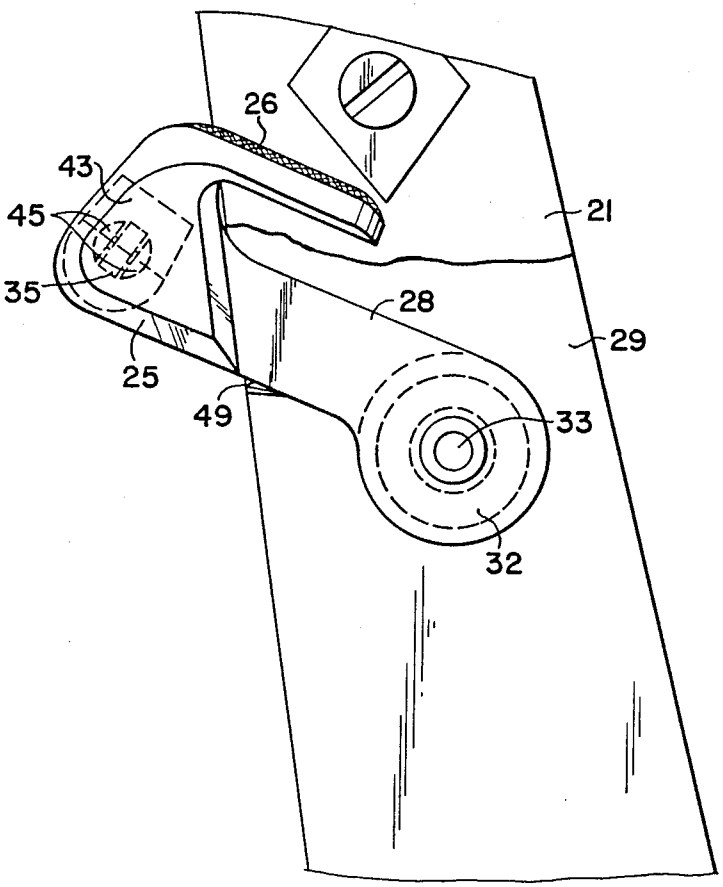
FIG. 6 is a left side elevation of the lever and its support plate in the handle portion of the gun.
Figure 9:
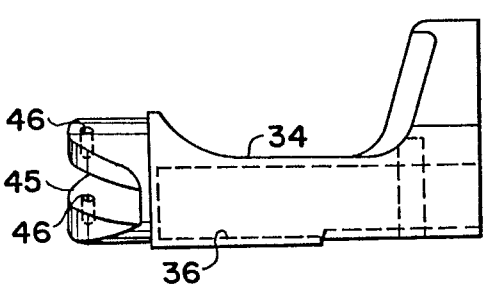
FIG. 9 is a bottom plan view of the magazine catch body of this invention.
Figure 10:
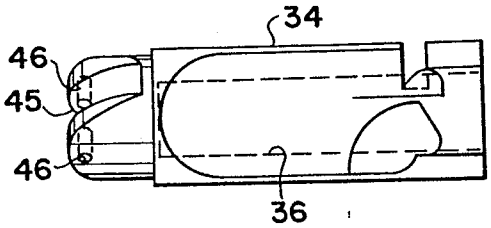
FIG. 10 is a rear elevation of the magazine catch body of this invention.
Figure 8:
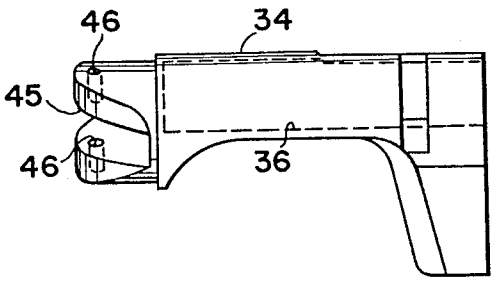
FIG. 8 is a top plan view of the magazine catch body of this invention.
Figure 11:
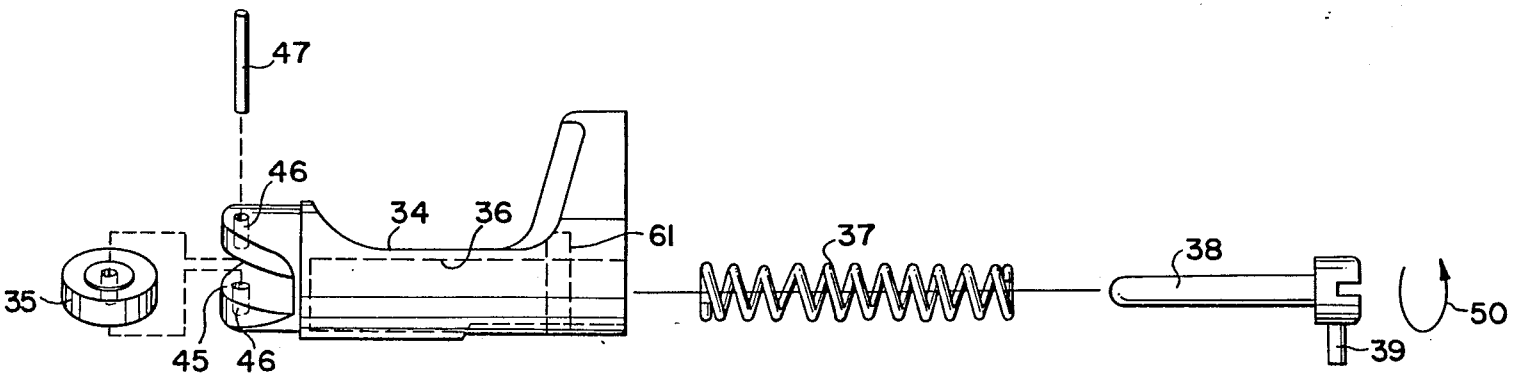
FIG. 11 is an exploded rear elevational view of the magazine catch body assembly.
Figure 12:
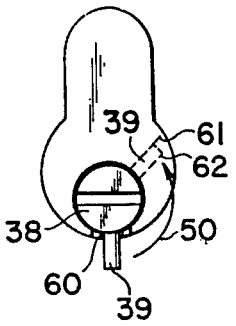
FIG. 12 is a right side elevational view of the magazine catch body assembly.
Figure 13:
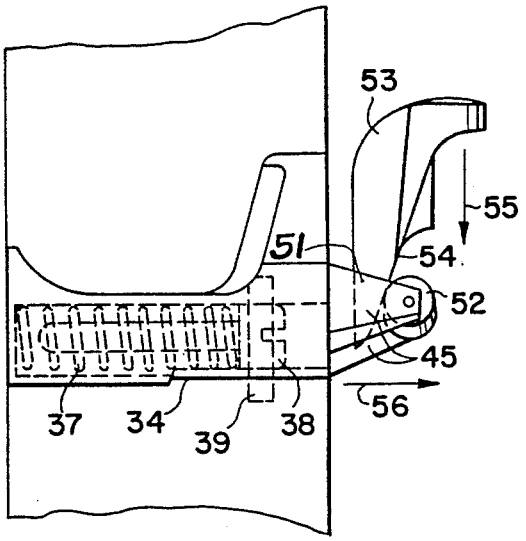
FIG. 13 is a rear elevational view of the magazine catch mechanism for a left-handed user.
Figure 14:
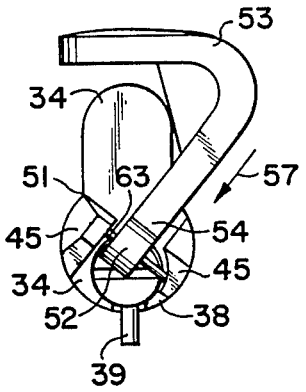
FIG. 14 is a right side elevational view of the magazine catch mechanism of FIG. 13.

FIGS. 6 and 7 are simplified views from the outside and inside of plate 29 to show its assembly with lever 25, bushing 32, and screw 33. In FIGS. 8–14 there are shown views of magazine catch body and its assembly. FIGS. 8–12 show these parts for a right-handed gun and FIGS. 13 and 14 show the parts for a left-handed gun. In FIGS. 8–12 the roller 35 is on the left end of magazine catch body 34 and is supported by a pair of support flanges 45 with roller 35 mounted on shaft 47 passing through shaft holes 46. Inside body 34 is a cylindrical recess 36 to receive spring 37 and guide pin 38. The head of pin 38 has a diametrical slot to receive a screwdriver bit to rotate pin 38. Extending outwardly from the head of pin 38 is arm 39 which slides in a longitudinal slot 60 in body 34 and then is rotated in slot 61 to lock pin 38 in place as a seat for spring 37. Arm 39 is rotated as shown by arrow 50 to its locked position.

In FIGS. 13 and 14 there are shown the magazine catch assembly for a left-handed gun. In this instance lever 53 (corresponding to 25 in FIGS. 1–12) is pressed downwardly in the direction of arrow 55 by the left hand thumb to cause body 34 to move from left to right (exactly the same as for the right hand gun in FIGS. 1–12). This movement is effected by a wedge shaped protuberance having an inclined cam surface 54 moving in the direction of arrow 57 in contact with roller 52 attached to body 34 by shaft 63 supported by a pair of flanges 45. Instead of pushing body 35 inwards (as in FIG. 3) cam surface 54 pulls roller 52 and body 34 outward from the right side of the gun (which is exactly the same movement as caused by surface 43 working against roller 35 in a right hand gun. Passageway 38 through the frame of the gun in the handle portion 20 is identical in both the right hand and left hand guns).

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In an automatic pistol having a hollow hand grip portion to receive a magazine an improved quick release magazine catch mechanism comprising a pivotable thumb operated lever, a lever support plate, pivot pin means connecting said lever to said plate, a spring biased magazine catch slidably engaged with said hand grip portion and having a roller means engageable with an inclined plane on said lever to cause said catch to slide laterally when said lever is pivoted downwardly.

2. The magazine catch mechanism of claim 1 wherein said lever is positioned on the side of said hand grip portion adjacent the thumb of the hand holding the gun.

3. The magazine catch mechanism of claim 1 wherein said pivot pin means includes a bushing rotatably mounted in a hole in said lever support plate, and a screw passing through said bushing and engaging a threaded passageway in said lever.

4. The magazine catch mechanism of claim 1 wherein said lever includes a thumb engageable pad spaced forwardly of a threaded passageway for engagement with said pivot pin means, and a thin flat connecting bar rigidly joining said pad to said threaded passageway.

5. The magazine catch mechanism of claim: 4 wherein said gun includes a pair of grips or opposite sides respectively of said hand grip portion, and wherein said support plate, said pivot pin means, said threaded passageway, and said connecting bar are positioned internally of one of said grips and said thumb engageable pad is forward of and outside of said grip.

6. The magazine catch mechanism of claim 4 which additionally includes a stop means to prevent movement of said lever downwardly beyond a selected position.

7. The magazine catch mechanism of claim 6 wherein said stop means includes a member protruding outwardly from said connecting bar to prevent pivotal movement beyond said member.

8. The magazine catch mechanism of claim 1 wherein said magazine catch is a hollow rod member slideable in a corresponding passageway extending laterally through said hand grip portion and attached thereto with an internal spring biased to urge said rod member away from the point of attachment to said hand grip portion; said hollow rod having a member having a freely rotatable roller extending outward of said hand grip portion and rotatably engaged with an inclined plane on said lever adjacent said thumb pad, said plane and said roller being oriented to cause said rod member to slide laterally against said internal spring as said thumb pad is pushed downwardly.

9. The magazine catch mechanism of claim 1 wherein said gun includes a barrel slide assembly which moves rearwardly when the gun is fired, and wherein said lever support plate extends upwardly adjacent said barrel slide and spaced laterally away from said barrel slide to serve as a retaining wall to prevent the thumb of the user from contacting said barrel slide.

10. The magazine catch mechanism of claim 5 wherein said grip which is adjacent to said support plate is shaped on its surface contiguous with said support plate to receive said plate and portions of said pivot pin means so as to make the overall dimension from the outside of one grip to the outside of the other grip no larger than that dimension of said pistol not containing the magazine catch mechanism of this invention.

* * * * *